US007068172B2

(12) United States Patent
Yang et al.

(10) Patent No.: US 7,068,172 B2
(45) Date of Patent: Jun. 27, 2006

(54) METHOD AND APPARATUS FOR DEACTIVATING AN EAS DEVICE

(76) Inventors: Xiao Hui Yang, 7926 McCellan Rd., #3, Cupertino, CA (US) 95014; Arthur Bradley Fuss, 4235 Mary Ellen, #301, Studio City, CA (US) 91604

( * ) Notice: Subject to any disclaimer, the term of this patent is extended or adjusted under 35 U.S.C. 154(b) by 105 days.

(21) Appl. No.: 10/851,295

(22) Filed: May 21, 2004

(65) Prior Publication Data

US 2005/0258965 A1 Nov. 24, 2005

(51) Int. Cl.
*G08B 13/14* (2006.01)

(52) U.S. Cl. ..... 340/572.3; 340/572.1; 340/10.3

(58) Field of Classification Search ..... 340/572.3, 340/572.1, 572.4, 572.5, 10.1, 10.3
See application file for complete search history.

(56) References Cited

U.S. PATENT DOCUMENTS

| | | | |
|---|---|---|---|
| 4,686,516 | A | 8/1987 | Humphrey |
| 4,746,908 | A | 5/1988 | Montean |
| 5,059,951 | A | 10/1991 | Kaltner |
| 5,210,524 | A | 5/1993 | Schwarz et al. |
| 5,257,010 | A | 10/1993 | Rehder |
| 5,477,202 | A | 12/1995 | Zarembo et al. |
| 5,477,219 | A | 12/1995 | Zarembo et al. |
| 5,493,275 | A | 2/1996 | Easter |
| 5,594,420 | A | 1/1997 | Copeland et al. |
| 5,705,986 | A | 1/1998 | Zschirnt |
| 5,781,111 | A | 7/1998 | Easter et al. |
| 5,796,339 | A | 8/1998 | Drew et al. |
| 5,867,101 | A | 2/1999 | Copeland et al. |
| 5,907,465 | A | 5/1999 | Easter |
| 5,917,412 | A | 6/1999 | Martin |
| 5,990,794 | A | 11/1999 | Alicot et al. |
| 5,999,098 | A | 12/1999 | Lian et al. |
| 6,011,474 | A | 1/2000 | Coffey et al. |
| 6,060,988 | A | 5/2000 | Copeland et al. |
| 6,084,514 | A | 7/2000 | Kopp et al. |
| 6,084,515 | A | 7/2000 | Maitin et al. |
| 6,111,507 | A | 8/2000 | Alicot et al. |
| 6,114,961 | A | 9/2000 | Denholm et al. |
| 6,154,135 | A | 11/2000 | Kane et al. |
| 6,181,249 | B1 | 1/2001 | Maitin et al. |
| 6,208,235 | B1 | 3/2001 | Trontelj |
| 6,281,796 | B1 | 8/2001 | Canipe et al. |
| 6,396,455 | B1 | 5/2002 | Ely et al. |
| 6,486,782 | B1 | 11/2002 | Zarembo et al. |
| 6,650,227 | B1 * | 11/2003 | Bradin ..... 340/10.3 |
| 6,696,951 | B1 * | 2/2004 | Belka et al. ..... 340/572.1 |

* cited by examiner

*Primary Examiner*—John Tweel, Jr.
(74) *Attorney, Agent, or Firm*—Waters Law Office; Robert R. Waters; Brian W. Foxworthy

(57) ABSTRACT

A deactivator for deactivating label-style EAS devices is claimed. The preferred embodiment, of which, employs a microprocessor unit to control two transceiver coils, and a deactivation coil in series with a capacitor. The two transceiver coils are essentially two flat figure eights arranged concentrically but rotated through some angle with respect to each other. The transceiver coils are operated alternatively, first transmitting an interrogation signal and then listening for a response. When an EAS device is detected, the microprocessor unit drives the capacitor and deactivation coil at the system's resonant frequency to generate a high amplitude magnetic field then shifts the frequency of the driving current away from the resonant frequency to attenuate the magnetic field. A field sensor or current sensor provides feedback to the microprocessor to determine the resonant frequency of the system during a frequency sweep.

14 Claims, 3 Drawing Sheets

METHOD AND APPARATUS FOR DEACTIVATING AN EAS DEVICE

FIELD OF THE INVENTION

This invention relates generally to a method and apparatus for deactivating electronic article surveillance labels. More specifically, this invention relates to a method and apparatus for deactivating electronic article surveillance labels having a magnetic component within them which requires degaussing in order for the electronic article surveillance label to be deactivated.

BACKGROUND OF THE INVENTION

An age old problem in retail sales is shoplifting or theft. A modern method of dealing with this problem is the use of electronic article surveillance tags and labels, and associated detection systems. Generally, these tags and labels have small, passive electronic circuits enclosed within them, and the tags or labels are attached to merchandise in the store. The detection system includes various types of antennas located at store exits or other areas where security is desired. Transmitting antennas broadcast a signal of a specific frequency into the security zone, and if any EAS tag or label is in this area, its passive circuitry is excited, producing a signal. The signal broadcast by the transmitting antenna is sometimes called an interrogation signal, and it is tuned to a frequency that will produce a signal from the EAS tag or label that is strong enough to be detected by receiving antennas, also located at the security zone. This responding signal is a resonant response characteristic of the circuitry of the EAS device and is a multiple of the interrogation signal. Detection of an EAS signal within the security zone cues the system to emit an alarm to alert store employees or security.

It is highly undesirable to have alarms sound when merchandise that has been appropriately paid for is being removed from the store. Two typical approaches to prevent this problem are removing the EAS device at the check-out counter or leaving it attached to the merchandise and deactivating it there. The method of deactivating the EAS device depends on the particular elements in the passive circuit. If the circuit includes a capacitor, it may have an excessive voltage induced to break down the dielectric, or, similarly, a high voltage or static discharge may be used to destroy a diode, if present in the circuit. Destroying these elements also destroys the passive circuit. Some EAS devices utilize components which have magnetic characteristics, and some of these are deactivated by giving these components a magnetic bias which significantly changes the circuit's behavior, but more typical, is the use of a process called degaussing to demagnetize a circuit element having a magnetic characteristic. Degaussing entails exposing a magnetized object to an alternating magnetic field and then attenuating the magnitude of the field gradually to zero. Simply turning off the field will not degauss the object. Typically, this field is generated by passing a current through an electrical coil. In this case, degaussing the magnetic element changes the passive circuit enough that its resonant response to the interrogation signal is not detected by the receiving antennas in the system. Associated with the deactivation coils must be a means of triggering the deactivation cycle. Most often, this is a localized detection system similar to those detection systems placed for security, but specifically associated with the deactivation coil. Other triggering means include optical sensors and manual activation. The present invention is a method and apparatus for degaussing magnetic elements in these types of EAS devices, especially the extremely inconspicuous EAS labels.

DESCRIPTION OF THE PRIOR ART

The need for theft deterrence and the success of EAS systems in addressing this need has led to an abundance of development and prior art. Issues addressed by prior art patents include; controlling for the directional strengths and weaknesses of a generated magnetic field, methods of attenuating the field, circuit efficiency, dual use of coils, generating a strong local field without producing an extended field effecting nearby electronics, methods of charging circuit capacitors, and many other issues. Patents of particular relevance to the instant invention are discussed below.

U.S. Pat. No. 6,111,507 by Alicot et al. utilizes several coils in multiple circuit branches which also have capacitors in series with the coils and a switching means to switch between these branches. The various branches are composed of coils and capacitors in series and are powered by alternating current with the switching means switching between the various circuit branches at the points in the alternating cycle where current flow is zero. The coils generate the magnetic field desired to degauss the EAS labels and are arranged to compensate for the directional orientations in each others magnetic fields.

Alternative embodiments for Alicot include; a capacitor shared between circuit branches wherein the switching means switches the capacitor between being in series with different coils, a circuit with a rectifier to increase the AC frequency, and a circuit that uses the natural frequency of a capacitor and coil to increase the frequency of the magnetic field. Increasing the AC frequency allows higher rates of switching between the field generating coils and increases the speed with which an EAS label may be passed through the field and deactivated regardless of the orientation. All of the embodiments in Alicot are limited to multiples of the input power frequency or the natural frequencies of the capacitor and coil circuits, and rely on the natural decay of the capacitor and coil circuit to attenuate the field.

U.S. Pat. No. 5,493,275 by Easter utilizes a reference signal generator, coil driver and sensor, comparator, and controller to drive the deactivator coil. The signal generator varies the amplitude of the signal being fed into the system while a comparator monitors the final signal input into the deactivator coil and the controller adjusts the signal based on the comparator results. Overall, Easter '275 controls the magnitude of the degaussing field by adjusting the amplitude of signal current to the coil. Higher amplitude input results in higher field magnitude. Attenuating the input amplitude to zero likewise reduces the field to zero. While Easter '275 utilizes feedback to adjust the drive current, it does so in comparison to a reference signal and not the system's response, so it does not adapt to varying environments.

U.S. Pat. No. 5,867,101 by Copeland has multiple coils arranged essentially horizontally. These coils are powered by currents which are, at times, in phase which each other, and then, at other times, out of phase with each other. This is intended to remedy the directional aspects of the generated fields which are created by the coils' horizontal positioning. Depending on the embodiment, the currents may be 180 degrees out of phase or 90 degrees out of phase. The time periods when the currents are in phase and out of phase alternate, and are of a short enough duration that all combination of phases and coils occur within the time frame of sweeping an EAS device past the coils. This exposes the device to fields of several orientations, making the orientation of the device itself less important.

SUMMARY OF THE INVENTION

In view of the prior art, it is a primary object of the present invention to provide an EAS deactivator which is adaptable to its surroundings.

It is an additional object of the present invention to provide an EAS deactivator having greater capability to control the attenuation of the magnetic field.

It is a further objective of the present invention to reduce the EMI interference associated with circuits of this general type.

It is yet another objective of the present invention to provide a system requiring fewer turns in the coil and therefore a lighter coil and unit.

It is a still further objective of the present invention to provide a deactivator system which can have its frequency adjusted with software as opposed to requiring changing the capacitors wired into the circuit.

It is a yet still further objective of the present invention to provide a low profile deactivator capable of detecting EAS devices regardless of the orientation of the EAS devices.

It is a further objective of the present invention to provide a deactivator that does not generate excessive heat.

It is also an objective of the present invention to provide a deactivator that does not require electronic components of excessively tight tolerances.

Likewise, it is an objective of the present invention to provide a deactivator that does not require excessively expensive electronic components.

Physical systems have resonance frequencies, and when they are stimulated at those frequencies, they respond with larger amplitudes than when stimulated at nonresonant frequencies. Electrical coils and capacitors in series have resonant behaviors well known in the electrical arts. However, few circuits are in actuality as simple as a coil and capacitor in series, which themselves do not behave entirely in accord with their theoretical models. In addition to additional electrical components, a circuit may be influenced by its surroundings. In particular, since a coil having an alternating current passing through it will generate an alternating magnetic field, ferrous objects in the field will act as an impedance in the field and therefore, as an impedance in the circuit, change the electrical system and its resonant frequency response.

The present invention monitors the circuit via the field output of the coil, current flow, or other electromagnetic parameters and utilizes a feedback loop to adjust the coil driving input frequency to the resonant frequency of the system in that environment. Driving the coil at the system resonant frequency reduces the impedance and maximizes the field output per given energy input. Degaussing requires the attenuation of the magnetic field. In the present invention, field attenuation is accomplished by adjusting the driving frequency away from the resonant frequency of the system, usually to a higher frequency. As this occurs, the magnitude of the field output is decreased due to increased impedance in the system and circuit.

The deactivator coil and capacitor circuit are driven by a microprocessor control unit, or MCU, at frequencies in the range of 300–400 Hz, typically, but is not limited to that range. This allows the frequency to be changed with software controls and is independent of any multiples of the power frequency. The MCU also operates the system for detecting the EAS devices and processes the feedback from the field measuring sensor.

There are various means available for triggering the deactivating cycle. A preferred embodiment of the present invention uses two transceiver coils, operating in alternating fashion. The first coil sends a signal and listens for a response and then the other coil does so. The coils are in roughly a figure eight shape and concentric with each other, but rotated through some angle so that they compensate for the directional aspects of each other's fields.

There has thus been outlined in a broad sense, the more important features of the present invention in order that the detailed description thereof that follows may be better understood, and in order that the present contribution to the art may be better appreciated. There are, of course, additional features of the invention that will be described hereafter which will form the subject matter of the invention.

In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may be readily utilized as a basis for the designing of other structures, methods, and apparatus for carrying out the purposes of the invention.

BRIEF DESCRIPTION OF THE DRAWINGS

Additional utility and features of the invention will become more fully apparent to those skilled in the art by reference to the following drawings, which thoroughly illustrate the primary features of the present invention.

DETAILED DESCRIPTION OF THE PREFERRED EMBODIMENT

Figure 1:
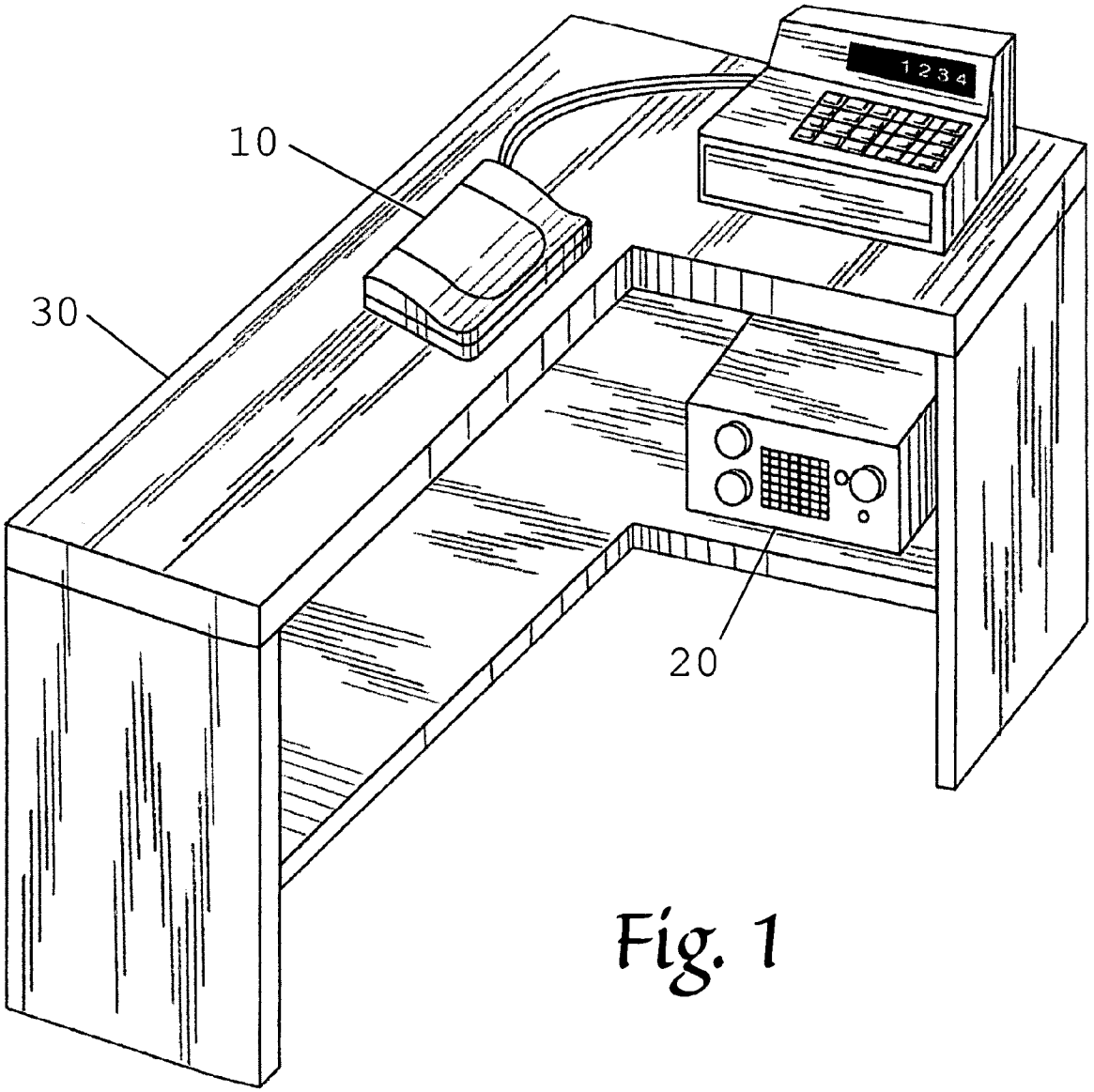
FIG. 1 depicts the deactivator unit on a check-out counter in a retail store where it might be used.

The detailed description below is for a preferred embodiment in which the microprocessor control unit operates transceiver coils and a degaussing coil with the assistance of a feedback loop. Specifically, the embodiment shown in the drawings and discussed below encloses the electrical coils in a generally flat housing and provides an alternating current to drive the circuit, while monitoring the system output. It is to be understood that a variety of other arrangements are also possible without departing from the spirit and scope of the invention.

Furthermore, before referring to the accompanying Figures, additional details regarding the preferred embodiment may be stated. The present embodiment of the invention has the control components of the circuitry separated from the field generating components. To utilize a fixed working frequency with this arrangement, the parameters of each component would have to be closely matched which would in turn require extremely demanding tolerances on the capacitor and the deactivation coil's inductance. The inherent variation in winding a coil requires the tolerances on the capacitor to be even tighter to make up for that variation. The result would be the requiring of an extremely expensive, tight tolerance capacitor.

The present invention avoids the drawbacks encountered when operating control components separated from field generating components at a fixed working frequency. It accomplishes this by employing a new dynamic working frequency method. Feedback control technology is applied to current measurements to tune the dynamic working frequency to the actual characteristics of the components.

By using a feedback control method such as that disclosed herein, the system can accommodate and "correct" for up to ten percent collective variance from the design specification for the components. This causes the optimum dynamic frequency to vary within the range of 300 Hz to 400 Hz and it is within this range that the control portion of the invention seeks a maximum current feedback value. The maximum current value is approximately 7 Amps and the deactivation field generated with this level of current has an effective deactivation height of 15 cm from the surface of the deactivation pad. The frequency range is swept when the power is initially applied to the control box of the invention. By actively seeking the best operating frequency for each set of components as assembled, the invention overcomes the need to use components finely tuned to each other. This allows wider tolerances for those components and greatly simplifies the manufacture of the capacitor and deactivation coil.

FIG. 1 shows the flat housing (10) containing both the detecting transceiver coils and deactivating coil and also the microprocessor control unit (20) placed on and under a check-out counter (30) respectively. Because the deactivation coil generates a magnetic field, if the actual counter top is metal or even covered with metal sheet, it can add a significant impedance into the generated magnetic field and therefore into the electrical system of the deactivator. This changes the performance characteristics of such a system and the present invention utilizes the programmability and versatility of a microprocessor control unit (20) to tune the deactivator coil to its environment and to operate it efficiently. It should be noted that while the illustrated counter top (30) would present a relatively stable environment, placing metallic objects on the counter top (30) in proximity to the coil housing (10) would also affect the field and circuit. Since the prevalence of metallic structures or items at a checkout counter may vary widely among retail establishments, prior art systems are often ineffective, while the system of the present invention is immune to such items since the MCU simply adjusts for field variations.

Figure 2:
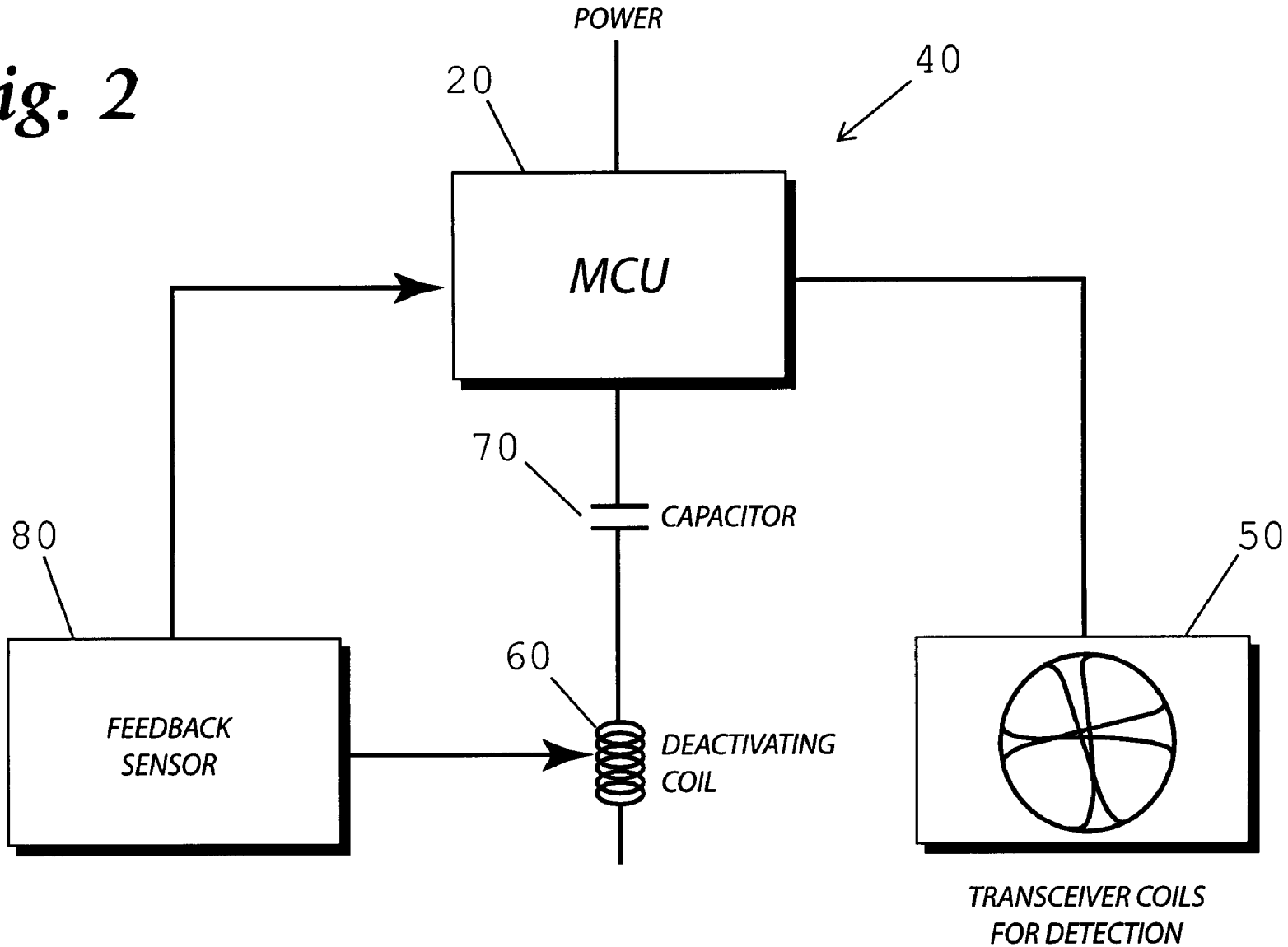
FIG. 2 shows a block diagram of the primary elements of the present invention.

FIG. 2 depicts schematically the deactivator (40) of the present invention. The individual elements contained in the housing (10) of FIG. 1 are shown as well as the microprocessor control unit (20). The individual elements are the transceiver coils (50), the deactivating coil (60), the capacitor (70) in series with the deactivating coil (50), and the feedback sensor (80).

In the preferred embodiment, there are two transceiver coils (50) shaped generally like figure eights. The central intersection of the figure eights are aligned, but the loops of the eights are rotated some angle with respect to each other. This allows the transceiver coils (50) to detect an EAS device brought into proximity regardless of the orientation of the EAS device. The shaped coils generate detection fields that have directional strengths and weaknesses. Their rotation with respect to each other allows them to compensate for the directional weaknesses of each other. In operation, the transceivers are operated alternately. The first one generates an interrogation signal and then stops to listen for a harmonic response from an EAS device, and then the other operates in the same fashion. This sequence happens very rapidly and continuously, while the system is on, and insures that an EAS device will be detected regardless of its orientation.

When an EAS device is detected, the MCU (20) generates an alternating current to drive the capacitor (70) and deactivating coil (60). The maximum field is generated when the capacitor (70) is charged to a maximum voltage and the alternating current is matched to the resonant frequency of the system, which has already compensated for anything in the surroundings that would influence the impedance of the capacitor (70) and coil (60) in series. The frequency of the current is matched to the resonance frequency by the MCU (20) through the use of a feedback signal. The feedback signal is generated by a feedback sensor (80) which monitors a circuit parameter, such as the field magnitude or the current. When the driving current's frequency matches that of the system, the impedance reaches a minimum and both the deactivation field amplitude and current are maximized for given voltages. In the preferred embodiment, both a field sensor and a current sensor are used as the feedback sensor (80) to monitor the system. The MCU (20) performs a frequency sweep by varying the frequency of the driving current and monitoring the feedback signal from the feedback sensor (80) to determine when the field amplitude and current are maximized. This sweep may be performed at the start-up of the system, periodically, or with each deactivation to maximize the field amplitude.

Figure 3:
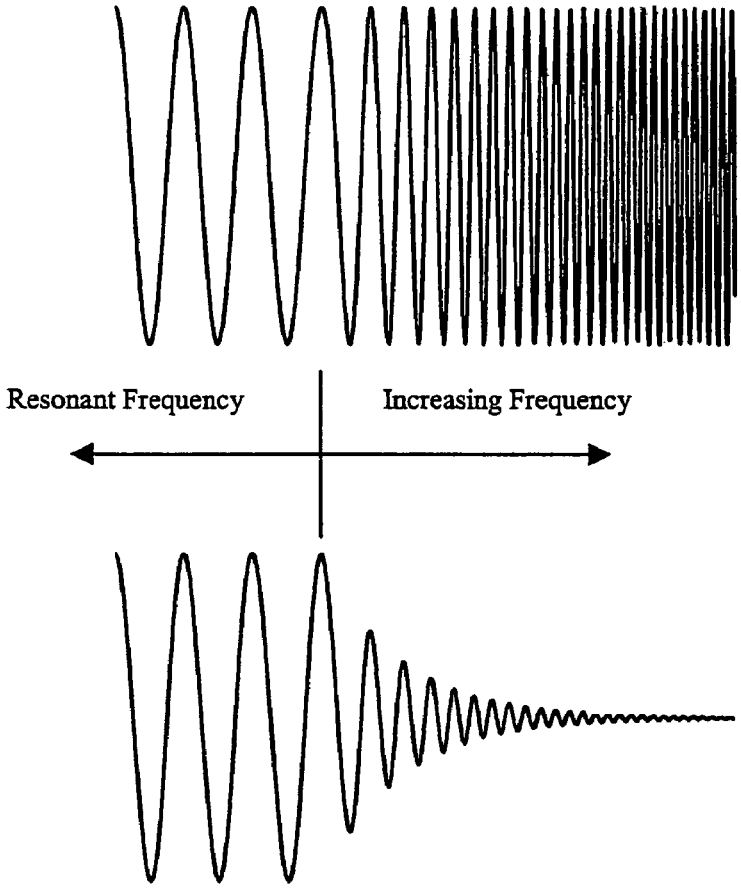
FIG. 3 shows a driving current of constant amplitude and changing frequency above the resulting change in field amplitude.

Once the maximum field amplitude has been generated, the field must be attenuated in a controlled fashion to effect the degaussing of the EAS device. This is done by shifting the frequency of the driving current away from the resonant frequency of the system, which increases the impedance, and decreases the amplitude of the field generated. This is illustrated in FIG. 3 wherein a graph depicting the alternating driving current generated by the MCU is aligned above a graph depicting the corresponding output field amplitude. In the initial section, the current has a constant frequency matching the resonant frequency of the system and consistent field amplitude. In the later section, the frequency of the current is increased away from the resonant frequency of the system and the resulting attenuation of the output field is shown. This attenuation results in degaussing the magnetic element in the EAS device, disabling the passive circuit.

A result of generating the maximum magnetic field at the resonance frequency of the system is a lack of distortion of the sinusoidal form of the alternating current driving the system. This produces a field with less of the higher frequency components present in complex systems. These higher frequency components are noticed as interference in nearby electronic devices. Therefore, by generating the maximum amplitude of the magnetic field at the resonant frequency, the interference components are minimized when the field is the greatest. The field is attenuated by shifting away from the resonant frequency. The return of higher frequency components occurs when the field is decreasing.

Figure 4:
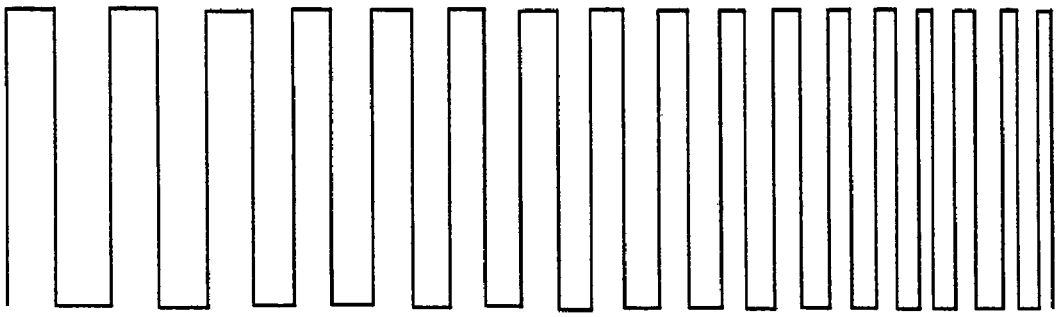
FIG. 4 shows possible wave forms generated by the microprocessor control unit.

The versatility of the MCU allows the waveform of the driving current to be changed. This further affects the field output of the system. FIG. 4 shows a square wave input of varying frequency.

While the preferred embodiment of the present invention places the transceiver coils and the degaussing coil in an essentially planar arrangement, it should be recognized that other coil arrangements could be used without departing in any meaningful way from the spirit of the invention. Likewise, the use of separate interrogation coils and receiver coils would not be a meaningful change. The present inventions adaptability applies to changing circuitry and hardware as well as to the changing environment mentioned above.

We claim:

1. An EAS device deactivator comprising:

a) an electrical coil;

b) a capacitor in electrical series with said coil;

c) means for varying the frequency of the current driving said coil and capacitor;

d) means for monitoring said coil and capacitor; and e) means for adjusting said frequency of said driving current based upon the measurements provided by said means for monitoring.

2. The EAS device deactivator of claim 1 wherein said means for varying the frequency of the current driving said coil and capacitor comprises:

a programmable microprocessor.

3. The EAS device deactivator of claim 1 wherein said means for monitoring said coil and capacitor comprises:

a magnetic field sensor.

4. The EAS device deactivator of claim 1 wherein said means for monitoring said coil and capacitor comprises:

a current sensor.

5. The EAS device deactivator of claim 1 wherein said means for adjusting said frequency of said driving current comprises:

a feedback loop from said means for monitoring to said means for varying said frequency.

6. A method of deactivating an EAS device comprising:

a) driving a capacitor and coil system with current at the resonant frequency of said system, and b) shifting the frequency of the driving current away from said resonant frequency.

7. The method of claim 6 wherein;

a microprocessor generates the driving current.

8. The method of claim 7 wherein;

a) a sensor monitors the system, b) a feedback loop transmits the sensor readings to said microprocessor, and c) tunes said driving current to the resonant frequency of the system using the signal from the feedback loop.

9. An EAS device deactivator comprising:

a) an electrical coil;

b) a capacitor in electrical series with said coil;

c) means for varying the frequency of the current driving said coil and capacitor;

d) means for monitoring said coil and capacitor;

e) means for adjusting said frequency of said driving current based upon the measurements provided by said means for monitoring, and f) means for detecting an EAS device brought into proximity with said deactivator.

10. The EAS device deactivator of claim 9 wherein said means for varying the frequency of the current driving said coil and capacitor comprises:

a programmable microprocessor.

11. The EAS device deactivator of claim 9 wherein said means for monitoring said coil and capacitor comprises:

a magnetic field sensor.

12. The EAS device deactivator of claim 9 wherein said means for monitoring said coil and capacitor comprises:

a current sensor.

13. The EAS device deactivator of claim 9 wherein said means for adjusting said frequency of said driving current comprises:

a feedback loop from said means for monitoring to said means for varying said frequency.

14. The EAS device deactivator of claim 9 wherein said means for detecting an EAS device, comprises;

a) at least two generally flat transceiver coils, arranged concentrically and rotated some angle with respect to each other, and wherein, b) each transceiver coil broadcasts an interrogation signal and then waits for a response signal serially with other said transceiver coils, so that only one transceiver coil is broadcasting or receiving at any given time.

* * * * *